US011982153B2

(12) United States Patent
Helms

(10) Patent No.: US 11,982,153 B2
(45) Date of Patent: May 14, 2024

(54) MANAGED PRESSURE REVERSE CEMENTING AND VALVE CLOSURE

(71) Applicant: Halliburton Energy Services, Inc., Houston, TX (US)

(72) Inventor: Lonnie Carl Helms, Humble, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 9 days.

(21) Appl. No.: 17/868,454

(22) Filed: Jul. 19, 2022

(65) Prior Publication Data

US 2024/0026750 A1 Jan. 25, 2024

(51) Int. Cl.
*E21B 33/14* (2006.01)
*E21B 34/08* (2006.01)

(52) U.S. Cl.
CPC ..... *E21B 33/14* (2013.01); *E21B 34/08* (2013.01)

(58) Field of Classification Search
CPC ..... E21B 33/14
See application file for complete search history.

(56) References Cited

U.S. PATENT DOCUMENTS 6,082,451 A * 7/2000 Giroux ..... E21B 21/10 166/153
10,890,046 B2 1/2021 Singh et al.
11,261,703 B1 3/2022 Helms
2003/0029611 A1 2/2003 Owens
2004/0231846 A1 11/2004 Griffith et al.
2005/0034863 A1 2/2005 Dillenbeck et al.
2006/0086499 A1* 4/2006 Badalamenti ..... E21B 33/14 166/250.14
2011/0094742 A1 4/2011 Badalamenti et al.
2018/0274327 A1* 9/2018 Patil ..... C04B 28/02
2021/0238983 A1* 8/2021 Singh ..... E21B 47/107
2021/0246759 A1 8/2021 Cao et al.
2021/0404269 A1* 12/2021 Sen ..... E21B 33/14
2022/0120172 A1 4/2022 Luo et al.

OTHER PUBLICATIONS

International Search Report & Written Opinion; PCT Application No. PCT/US2023/021162; Mailed Aug. 29, 2023.

* cited by examiner

*Primary Examiner* — William D Hutton, Jr.
*Assistant Examiner* — Avi T Skaist
(74) *Attorney, Agent, or Firm* — NOVAK DRUCE CARROLL LLP

(57) ABSTRACT

Systems and methods are provided for determining the end of a reverse cementing operation based on one or more pressure measurements. In some aspects, a cement composition can be delivered to an annulus formed between a casing and a wellbore for reverse cementing the casing. In some cases, a determination that the cement composition has reached a shoe joint at a bottom portion of the casing can be based on a threshold change in a pressure measurement obtained while delivering the cement composition. In some instances, a trigger can be initiated for closing the shoe joint after determining that the cement composition has reached the shoe joint.

20 Claims, 5 Drawing Sheets

300

MANAGED PRESSURE REVERSE CEMENTING AND VALVE CLOSURE

TECHNICAL FIELD

The present disclosure relates generally to systems and methods for reverse cementing, and more specifically (although not necessarily exclusively), to systems and methods for determining the end of a reverse cementing operation based on one or more pressure measurements.

BACKGROUND

Wellbores are formed by drilling deep into subterranean formations in order to withdraw hydrocarbons. Typically, the wellbore is lined with a steel casing string (or casing) after drilling in order to maintain the shape of the wellbore and to prevent loss of fluids to the surrounding environment. The steel casing is often bonded to the surface of the wellbore by a sealant such as cement. Cementing operations are carried out to inject cement into the annulus between the casing and the wellbore.

Customary cementing operations can include pumping cement through the bore of the casing, out the bottom of the casing, and up through the annulus between the surface of the wellbore and the external surface of the casing. Other cementing operations include reverse cementing in which cement is pumped from the surface through the annulus of the wellbore, into the bore of the casing, and up toward the surface. Reverse cementing may be used to reduce cementing pressure because the cement composition falls down the annulus, reducing the pressure on the formation.

DETAILED DESCRIPTION

Figure 1:
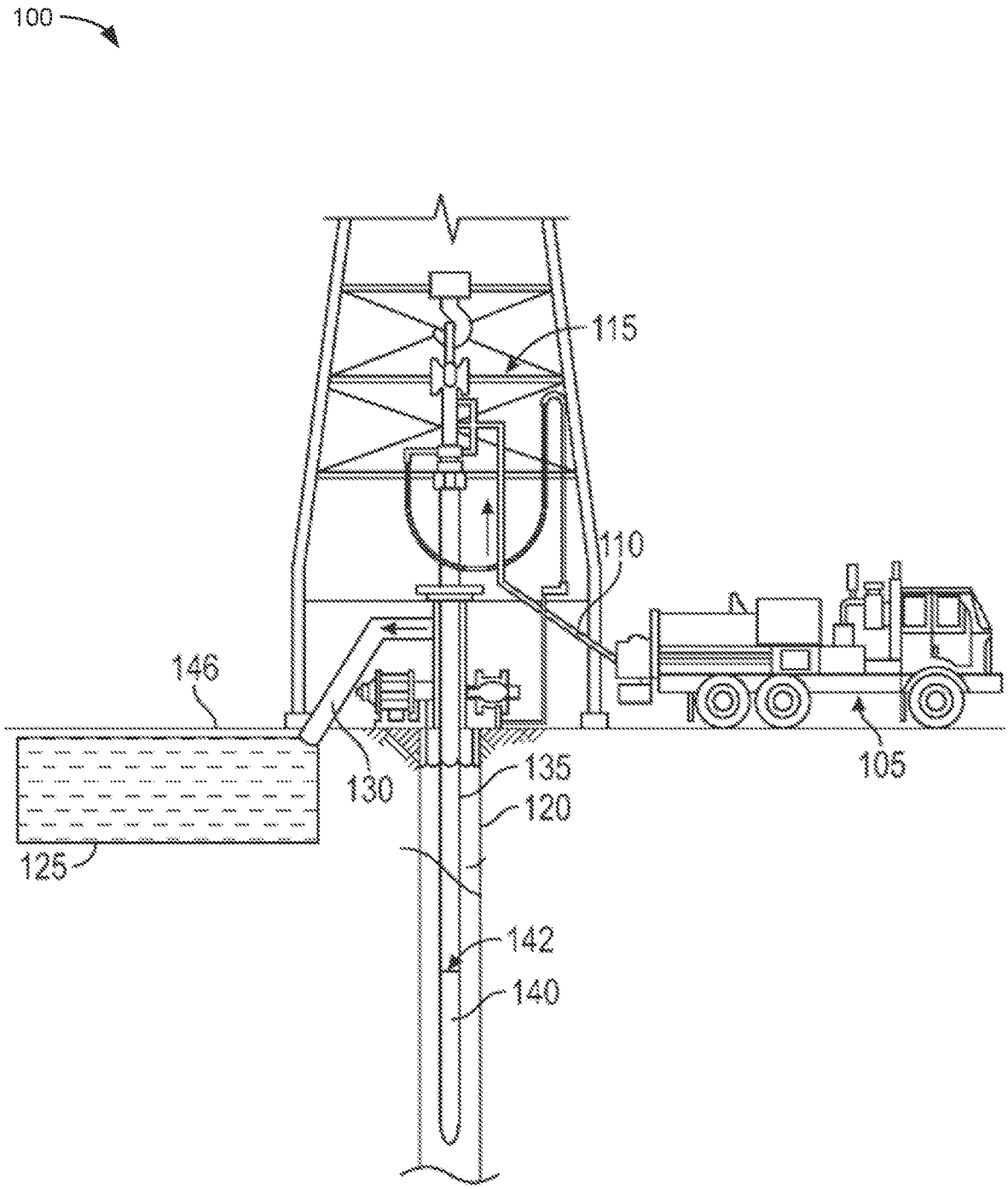
FIG. 1 is a system diagram of a wellbore environment, in accordance with aspects of the present disclosure.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be apparent from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

As used herein, "cement" is any kind of material capable of being pumped to flow to a desired location, and capable of setting into a solid mass at the desired location. "Cement slurry" designates the cement in its flowable state. In many cases, common calcium-silicate hydraulic cement is suitable, such as Portland cement. Calcium-silicate hydraulic cement includes a source of calcium oxide such as burnt limestone, a source of silicon dioxide such as burnt clay, and various amounts of additives such as sand, pozzolan, diatomaceous earth, iron pyrite, alumina, and calcium sulfate. In some cases, the cement may include polymer, resin, or latex, either as an additive or as the major constituent of the cement. The polymer may include polystyrene, ethylene/vinyl acetate copolymer, polymethylmethacrylate polyurethanes, polylactic acid, polyglycolic acid, polyvinylalcohol, polyvinylacetate, hydrolyzed ethylene/vinyl acetate, silicones, and combinations thereof. The cement may also include reinforcing fillers such as fiberglass, ceramic fiber, or polymer fiber. The cement may also include additives for improving or changing the properties of the cement, such as set accelerators, set retarders, defoamers, fluid loss agents, weighting materials, dispersants, density-reducing agents, formation conditioning agents, loss circulation materials, thixotropic agents, suspension aids, or combinations thereof.

The cement compositions disclosed herein may directly or indirectly affect one or more components or pieces of equipment associated with the preparation, delivery, recapture, recycling, reuse, and/or disposal of the disclosed cement compositions. For example, the disclosed cement compositions may directly or indirectly affect one or more mixers, related mixing equipment, mud pits, storage facilities or units, composition separators, heat exchangers, sensors, gauges, pumps, compressors, and the like used to generate, store, monitor, regulate, and/or recondition the exemplary cement compositions. The disclosed cement compositions may also directly or indirectly affect any transport or delivery equipment used to convey the cement compositions to a well site or downhole such as, for example, any transport vessels, conduits, pipelines, trucks, tubulars, and/or pipes used to compositionally move the cement compositions from one location to another, any pumps, compressors, or motors (e.g., topside or downhole) used to drive the cement compositions into motion, any valves or related joints used to regulate the pressure or flow rate of the cement compositions, and any sensors (i.e., pressure and temperature), gauges, and/or combinations thereof, and the like. The disclosed cement compositions may also directly or indirectly affect the various downhole equipment and tools that may come into contact with the cement compositions/additives such as, but not limited to, wellbore casing, wellbore liner, completion string, insert strings, drill string, coiled tubing, slickline, wireline, drill pipe, drill collars, mud motors, downhole motors and/or pumps, cement pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber-optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like.

As discussed previously, it is difficult to accurately detect the presence and location of a composition that is pumped into a wellbore during a cementing operation. In particular, during a reverse cementing operation, it is difficult to determine when the cement composition and/or other fluid (e.g., spacer) reaches the bottom of the annulus and enters the bore of the casing. Failure to determine when the cement composition enters the casing can result in waste as excessive cement may be pumped up into the casing and/or it may result in a deficient cementing operation as the level of the cement in the annulus may be below a desired level.

The disclosed technology addresses the foregoing by providing methods and systems for detecting presence of a composition at the bottom of the casing. More specifically, the disclosed technology addresses the foregoing by providing methods and systems for detecting presence of cement composition at the bottom of the casing (e.g., shoe joint) by detecting an inflection in pressure. The disclosed technology also provides methods and systems for triggering closure of the shoe joint to prevent additional flow of the cement composition into the casing in order to complete the reverse cementing operation.

In some aspects, a method can include delivering a cement composition to an annulus formed between a casing and a wellbore for reverse cementing the casing. A determination that the cement composition has reached a shoe joint at a bottom portion of the casing can be based on a threshold change in a pressure measurement obtained while delivering the cement composition. A further amount of the cement composition can be delivered to the annulus in response to determining that the cement composition has reached the shoe joint at the bottom portion of the casing. The shoe joint may be closed after delivering the further amount of the cement composition.

In some cases, an apparatus can include at least one memory comprising instructions and at least one processor configured to execute the instructions and cause the apparatus to receive one or more pressure measurements associated with a closed wellbore during a reverse cementing operation. Based on a threshold change in at least one of the one or more pressure measurements, the apparatus can determine that a composition delivered through an annulus of the closed wellbore has reached a bottom portion of a casing within the closed wellbore. The apparatus can initiate a trigger for closing a shoe joint after determining that the composition has reached the bottom portion of the casing.

In various embodiments, a system can include a casing extending into a wellbore, wherein an annulus is formed between the casing and the wellbore. The system can also include a shoe joint positioned proximate to a bottom portion of the casing. The shoe joint can include at least one valve that can be configured to prevent flow of a cement composition from the annulus into the casing when the at least one valve is in a closed position. The system can also include a pressure sensor configured to detect a trigger for actuating the at least one valve to the closed position.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 illustrates an exemplary downhole environment 100 in which the present disclosure may be implemented. In some cases, the cement unit 105, which may be a truck as shown, may include mixing equipment and pumping equipment. In some examples, the cement unit 105 may pump a cement slurry (e.g., cement composition) through a feed pipe 110 and to a cement head 115 which can convey the cement, or other fluid, downhole, for example into the wellbore 120. In some instances, a retention pit 125 may be provided into which displaced fluids from the wellbore 120 may flow via line 130 (e.g., a mud pit).

In some examples, a casing 135 may be inserted from the surface 146 of the earth into the wellbore 120. In some cases, the casing 135 may be a plurality of individual tubes or joints. In some embodiments, the casing 135 may include a reverse cementing apparatus 140 on the downhole end 142 thereof, the uphole end being toward the surface 146. In some aspects, the reverse cementing apparatus 140 may correspond to a shoe joint (e.g., a shoe, shoe track, float joint, float shoe, casing shoe, etc.).

In some instances, during a Run-In-Hole stage the casing 135 may be inserted into the wellbore 120. During this stage, fluid may be pumped through the casing 135 in a downhole direction toward the end of the wellbore 120. Once the reverse cementing apparatus 140 is positioned in the desired location in the wellbore 120 then reverse cementing operations may be started. It should be noted that while FIG. 1 generally depicts a land-based operation, those skilled in the art will readily recognize that the principles described herein are equally applicable to subsea operations that employ floating or sea-based platforms and rigs, without departing from the scope of the disclosure.

Figure 2:
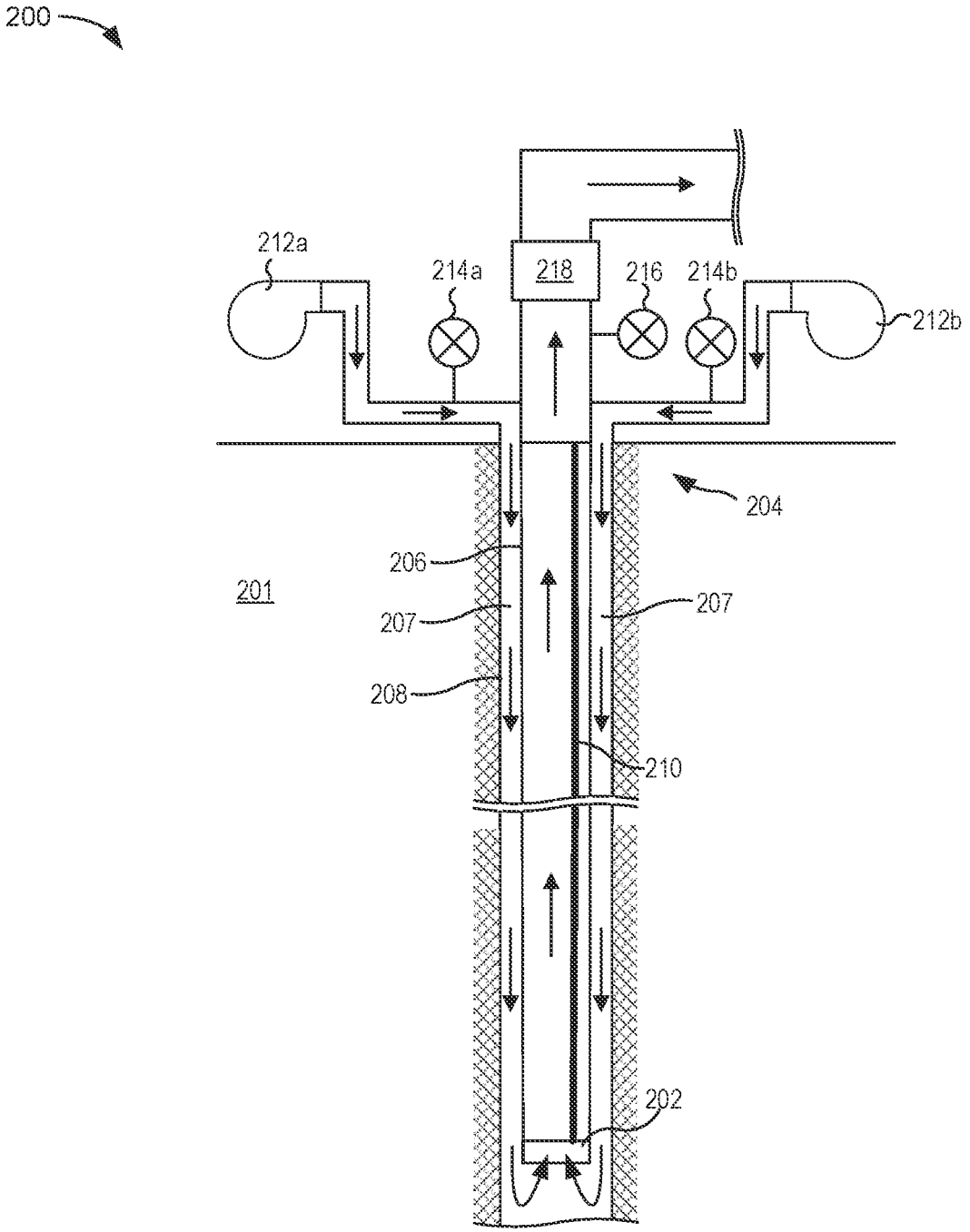
FIG. 2 is a system diagram of a wellbore environment illustrating reverse cementing operations, in accordance with aspects of the present disclosure.

FIG. 2 is a system diagram of a wellbore environment 200 for implementing reverse cementing operations. As illustrated, a wellbore 204 penetrates a portion of subterranean formation 201. In some aspects, the wellbore environment 200 may include a casing 206 (e.g., a casing string or a pipe string that may be a single pipe string or a joined pipe string). In some examples, casing 206 may include other equipment for placing the casing 206 into the wellbore 204, such as a shoe (e.g., shoe 202), a float collar, a centralizer, etc.

In some examples, the wellbore environment 200 may include a choke valve 218 (e.g., a choke manifold) at or near the outlet of casing 206. In some instances, choke valve 218 may include one or more isolation valves that are operable by a controller (not illustrated) to maintain backpressure in the casing 206 (e.g., via a wellhead). In some embodiments, pressure sensor 216 connected between choke valve 218 and casing 206 can be used to monitor pressure at an outlet of the casing 206. In some cases, choke valve 218 can be used to create pressure pulses for communicating with shoe 202, as described further below.

In some aspects, an annulus 207 may be formed between casing 206 and a wall 208 of the wellbore 204. In some examples, a reverse cementing operation can be performed using one or more cementing pumps (e.g., cementing pump 212*a* and/or cementing pump 212*b*) to pour a cement composition into the annulus 207. In some aspects, one or more pressure sensors (e.g., pressure sensor 214*a* and/or pressure sensor 214*b*) can be used to monitor discharge pressure at the output of cementing pumps 212*a* and/or 212*b*.

In some aspects, pressure monitoring can be used to determine when materials or fluids (e.g., cement composition, cement slurry, spacer, mud, etc.) reach the bottom of casing 206 (e.g., the bottom of the string). For example, monitoring pressure at the choke valve 218 using pressure sensor 216 and/or monitoring pressure at the output of cementing pumps 212*a* and/or 212*b* using pressure sensors 214*a* and/or 214*b* can be used to detect a threshold change in pressure (e.g., a pressure inflection). In some cases, a threshold change in pressure or a pressure inflection may be observed when heavier external materials or fluids have entered casing 206 during reverse cementing operation. In some aspects, an increase in displacement pressure can be observed to lift the heavier external materials or fluids inside of casing 206. For example, pressure at choke valve 218 at the outlet of casing 206 can increase when the lead cement slurry or a heavy-weight spacer reaches a bottom portion of the wellbore and enters casing 206. In addition, or alternatively, pressure at the output of cementing pumps (e.g., pressure sensors 214*a* and/or 214*b*) may increase when the materials or fluids (e.g., cement slurry, spacer, etc.) enter casing 206.

In some cases, choke valve 218 can be used to maintain backpressure in casing 206 (e.g., at pressure sensor 216) in order to keep a bottom flapper valve in shoe 202 open for reverse cementing. In one illustrative example, the backpressure during reverse cementing may be in the range of 200 to 300 pounds per square inch (PSI) prior to the cement composition entering casing 206, and the pressure may increase to approximately 500 PSI when the cement composition enters the bottom of casing 206 and/or shoe 202. In some cases, detecting the pressure increase can provide an indication that the cement composition has entered casing 206.

In further examples, the threshold pressure or pressure inflection may differ based on model of shoe 202. For instance, different models or configurations of shoe 202 (e.g., smart shoes, simple shoes, etc.) may require or tolerate different pressure levels within casing 206. In some instances, a "smart" shoe may include a flapper valve that can be configured for reverse cementing without application of backpressure in casing 206. In such cases, the threshold change in pressure (e.g., at cement pump and/or at casing outlet) for detecting entry of cement composition into casing 206 may be higher than 500 PSI.

In some aspects, shoe 202 may be equipped with a pressure sensor (not illustrated) that can be configured to monitor downhole pressure at shoe 202 (e.g., a bottom portion of casing 206). In some examples, the pressure sensor at shoe 202 can be used to detect the threshold pressure change during reverse cementing to determine entry of materials into casing 206. In some instances, pressure readings from shoe 202 can be communicated to a controller at the surface of wellbore 204 using waveguide 210. In transmitting a telemetry signal (e.g., pressure readings) from the shoe 202 to the surface of the wellbore 204, the waveguide 210 can be coupled to shoe 202 according to an applicable transmission medium through which the telemetry signal is capable of being transmitted. For example, the waveguide 210 can be one or a combination of acoustically coupled, optically coupled, and electrically coupled to the cement detection tool 202 to transmit a telemetry signal to the surface of the wellbore 204. In some examples, the waveguide 210 can be one or a combination of an optical waveguide, an acoustic waveguide, and a transmission line.

In some examples, detecting entry of materials into casing 206 (e.g., based on a threshold pressure change) may be used to trigger closure of shoe 202. In some aspects, closure of shoe 202 can prevent flow of fluid or materials into casing 206 from annulus 207 during a reverse cementing operation. In some cases, shoe 202 may be closed by adjusting or closing a valve (e.g., choke valve 218) to cause a sleeve at shoe 202 to change positions. In some instances, shoe 202 may be closed by transmitting a signal to shoe 202 (e.g., using waveguide 210). In some embodiments, shoe 202 may be closed by opening and closing choke valve 218 to cause a pressure pulse that can be detected by a pressure sensor at shoe 202. In some cases, the pressure pulse or series of pressure pulses that are detected by the pressure sensor at shoe 202 can serve as a trigger that initiates closure of shoe 202.

In some aspects, closure of shoe 202 may be performed after a certain amount of material (e.g., cement composition) has been pumped into casing 206. For instance, determining entry of cement composition at casing 206 may be used as a reference point to determine an additional amount of cement composition that is to be pumped into annulus 207 prior to closing the shoe 202. In some cases, the additional amount of cement composition can be based on an amount of time pumping at a particular rate, a number of barrels, a volume measurement, and/or a desired displacement. In some examples, closure of shoe 202 may also be used as a reference point to determine an additional amount of cement composition that is to be pumped in order to complete the reverse cementing operation.

In some instances, an approximate time for material to enter casing 206 can be determined prior to commencing a reverse cementing operation. For example, an approximate time for cement composition to enter casing 206 can be determined based on parameters such as well depth, wellbore geometry, wellbore temperature, cement composition density, cement composition flow rate, hydrostatic pressure, any other suitable parameter, and/or any combination thereof. In some aspects, the approximate time for the cement composition to enter casing 206 can be used to control the pump flow rate at or near the expected time for the cement composition to enter casing 206. In some examples, reducing the flow rate of the cement composition can minimize pressure variations and facilitate identification of the threshold pressure change (e.g., pressure inflection) due to cement composition entering casing 206.

Figure 3:
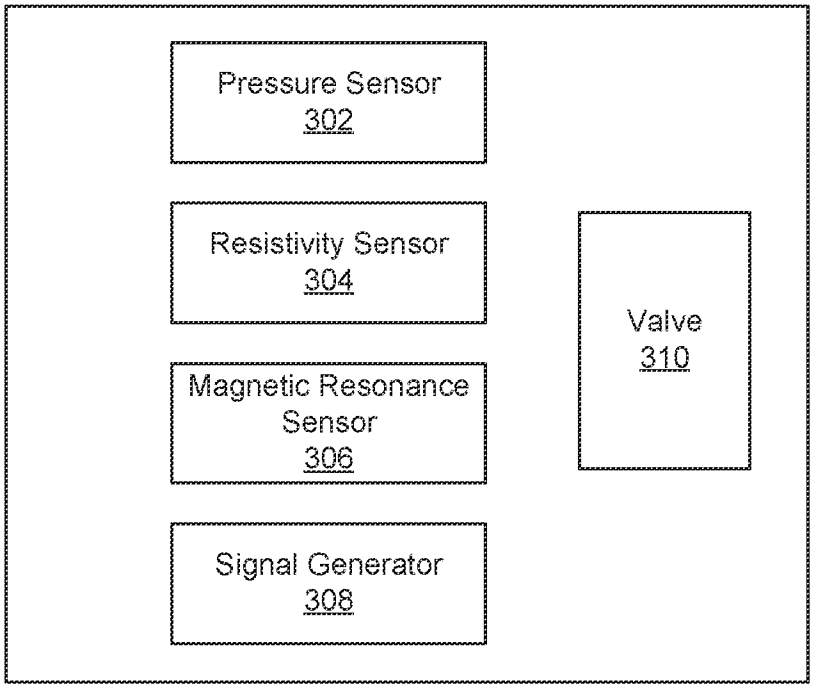
FIG. 3 is a block diagram of a shoe joint that may be used in reverse cementing operations, in accordance with aspects of the present disclosure.

FIG. 3 is a block diagram of a shoe 300 that may be used in reverse cementing operations. In some aspects, shoe 300 may correspond to shoe 202 as illustrated in FIG. 2 In some cases, shoe 300 may include pressure sensor 302. In some instance, pressure sensor 302 may be used to detect a change in pressure during reverse cementing operations. For example, pressure measurements obtained by shoe 300 positioned at a lower portion of a casing (e.g., casing 206)

will detect an inflection in pressure (e.g., threshold pressure change) when cement material enters casing 206.

In some aspects, pressure sensor 302 may detect pressure changes caused by opening and closing an outlet valve (e.g., at the wellhead). In some cases, a pressure pulse and/or a series of pressure pulses can be detected by pressure sensor 302 and may trigger shoe 300 to close valve 310. In some examples, closure of valve 310 prevents the flow of liquid or materials (e.g., cement composition) from entering a casing (e.g., casing 206). For instance, closure of valve 310 may cause movement of a sleeve (not illustrated) that blocks a reverse cementing port on shoe 300.

In some examples, shoe 300 may include resistivity sensor 304. In some cases, resistivity sensor 304 may identify different materials (e.g., mud, spacer, cement) based on changes in fluid resistivity. In some embodiments, the resistivity sensor 304 may determine when cement composition has entered a casing (e.g., casing 206) based on a resistance value (e.g., absolute value) and/or a change in resistivity. In some aspects, shoe 300 may send a signal to a controller at the surface of a wellbore based on measurements captured by resistivity sensor 304. In some examples, the controller may use resistivity data as an alternative or in addition to pressure data for determining when cement composition has entered the casing.

In some instances, shoe 300 may include a magnetic resonance sensor 306. In some cases, magnetic resonance sensor 306 can be configured to detect or pick up a concentration of additive magnetic particles in a cement slurry. In some examples, the magnetic resonance sensor 306 may determine when cement composition has entered a casing based on detection of the additive magnetic particles. In some aspects, shoe 300 may send a signal to a controller at the surface of a wellbore indicating the detection of the cement slurry by the magnetic resonance sensor 306. In some embodiments, the controller may use data from magnetic resonance sensor 306 as an alternative or in addition to pressure data and/or resistivity data for determining when cement has entered the casing.

In some cases, shoe 300 can include a signal generator 308. In some aspects, the signal generator 308 can be an applicable device for generating a signal that can be transmitted, e.g. towards a surface of a wellbore. Further, a telemetry signal generated by the signal generator 308 can be in an applicable form for transmission, e.g., towards a surface of a wellbore. For example, the signal generator 308 can be a light generating device, e.g., a light emitting diode, and the telemetry signal generated by the signal generator 308 can be an optical signal. In another example, the signal generator 308 can be a radio frequency (RF) signal generator and the telemetry signal generated by the signal generator 308 can include one or more radio waves. In yet another example, the signal generator 308 can be an acoustic signal generator and the telemetry signal generated by the signal generator 308 can include one or more acoustic waves. In another example, the signal generator 308 can be a pressure generating device and the telemetry signal generated by the signal generator 308 can include a signal formed by varying pressure in one or more applicable mediums. In yet another example, the signal generator 308 be a temperature varying device and the telemetry signal generated by the signal generator 308 can include a signal formed by varying temperature in one or more applicable mediums.

Figure 4:
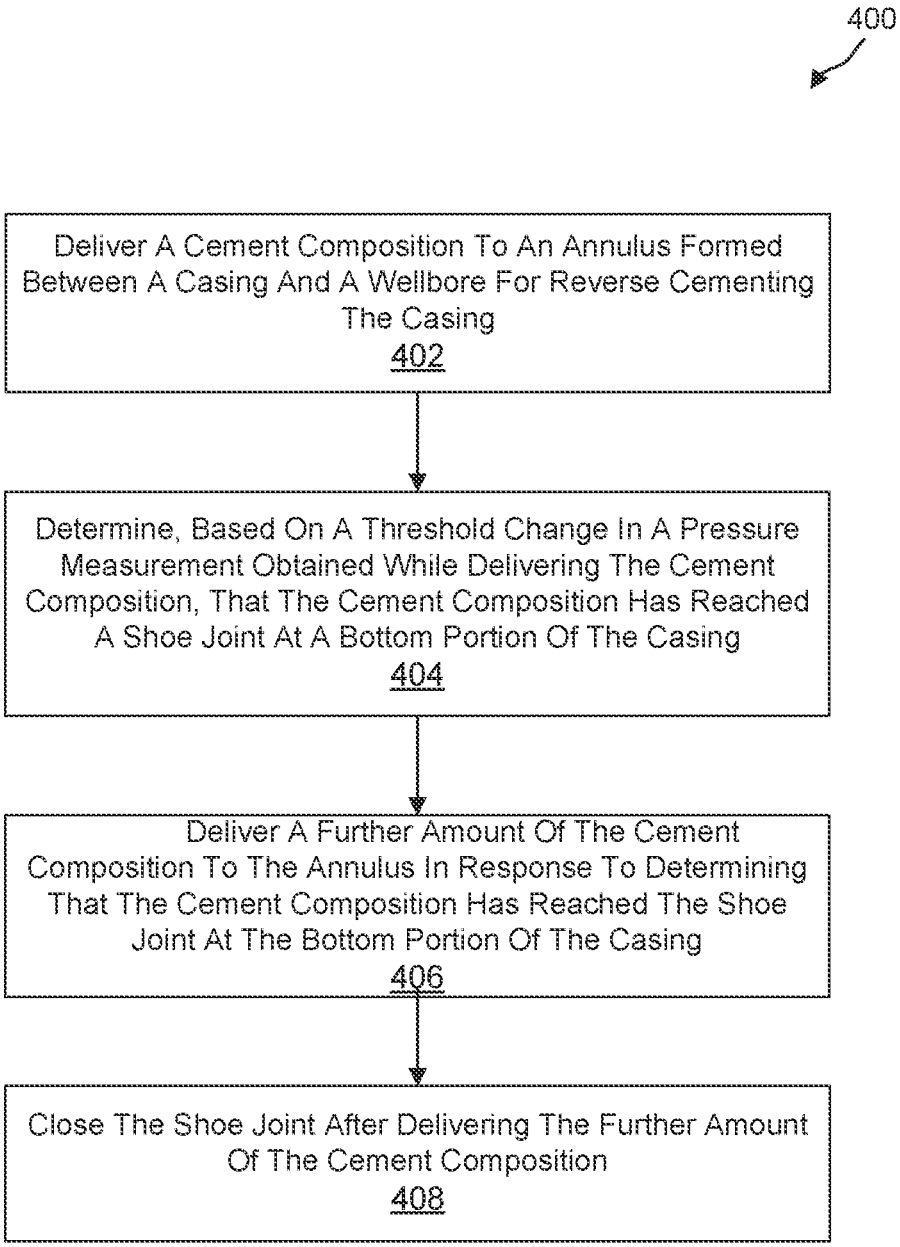
FIG. 4 is a flowchart diagram of a process of reverse cementing, in accordance with aspects of the present disclosure.

FIG. 4 illustrates an example of a process 400 for determining the end of a reverse cementing operation based on one or more pressure measurements. At block 402, the process 400 includes delivering a cement composition to an annulus formed between a casing and a wellbore for reverse cementing the casing. For examples, cementing pump 212*a* and/or cementing pump 212*b* can be used to deliver a cement composition to annulus 207 between casing 206 and wall 208 of wellbore 204 for reverse cementing casing 206.

At block 404, the process 400 includes determining, based on a threshold change in a pressure measurement obtained while delivering the cement composition, that the cement composition has reached a shoe joint at a bottom portion of the casing. For instance, a threshold change in a pressure measurement obtained by pressure sensor 214*a*, pressure sensor 214*b*, pressure sensor 216, and/or pressure sensor at shoe 202 can be used to determine that the cement composition has reached shoe 202 at bottom of casing 206. In some aspects, the pressure measurement can include at least one of an output pressure measurement corresponding to at an outlet of the casing and a discharge pressure measurement corresponding to an output of a cement pump used to deliver the cement composition. For example, the output pressure measurement corresponding to an outlet of casing 206 can be obtained by pressure sensor 216 and the discharge pressure measurement corresponding to an output of cement pump 212*a* can be obtained by pressure sensor 214*a*.

In some examples, the process 400 can include receiving an indication of the threshold change in the pressure measurement from the shoe joint. For example, shoe 202 may be coupled to a pressure sensor configured to measure pressure at a bottom portion of the casing 206. In some cases, shoe 202 may transmit a signal (e.g., using waveguide 210) that includes the pressure measurements obtained at the bottom portion of casing 206. In some examples, shoe 202 may transmit a signal upon detecting a threshold change in the pressure measurements at the bottom portion of casing 206.

At block 406, the process 400 includes delivering a further amount of the cement composition to the annulus in response to determining that the cement composition has reached the shoe joint at the bottom portion of the casing. In some cases, the further amount of the cement composition is based on at least one of a time duration, a number of barrels, a volume measurement, and a desired displacement. For example, pump 212*a* can be used to pump a further amount of cement to annulus 207 for an additional amount of time, a number of barrels, a cement volume, or a displacement value.

At block 408, the process 400 includes closing the shoe joint after delivering the further amount of the cement composition. For example, shoe 202 can be closed after delivering the further amount of the cement composition. In some cases, closing the shoe joint can include generating at least one pressure pulse using a valve at an outlet of the casing. For example, choke valve 218 can be used to generate a pressure pulse that can be detected by a pressure sensor coupled to shoe 202 and cause shoe 202 to close. In some examples, closing the shoe joint can include closing a valve at an outlet of the casing. For instance, closing the shoe 202 can include closing choke valve 218 at an outlet of casing 206.

In some aspects, the process 400 can include determining, based on one or more parameters, an expected time for the cement composition to reach the shoe joint at the bottom portion of the casing and reducing a flow of the cement composition within a threshold time prior to the expected time. For example, a controller associated with a reverse cementing operation of wellbore 204 may determine an expected time for the cement composition to reach shoe 202 at the bottom portion of casing 206. In some cases, the flow of the cement composition can be reduced within a threshold time prior to the expected time. For instance, the flow from cementing pump 212*a* can be reduced 10 minutes prior to the time when it is expected that the cement composition will enter casing 206.

In some cases, the one or more parameters for determining the expected time for the cement composition to reach the shoe joint can include well depth, wellbore geometry, wellbore temperature, hydrostatic pressure, cement composition density, and cement composition flow rate.

In some examples, the process 400 can include delivering a spacer fluid into the annulus prior to delivering the cement composition. For example, cementing pump 212*a* can be used to deliver a spacer fluid to annulus 207 prior to pumping a cement composition. In some cases, the threshold pressure change can be detected based on the spacer fluid entering the casing 206.

Figure 5:
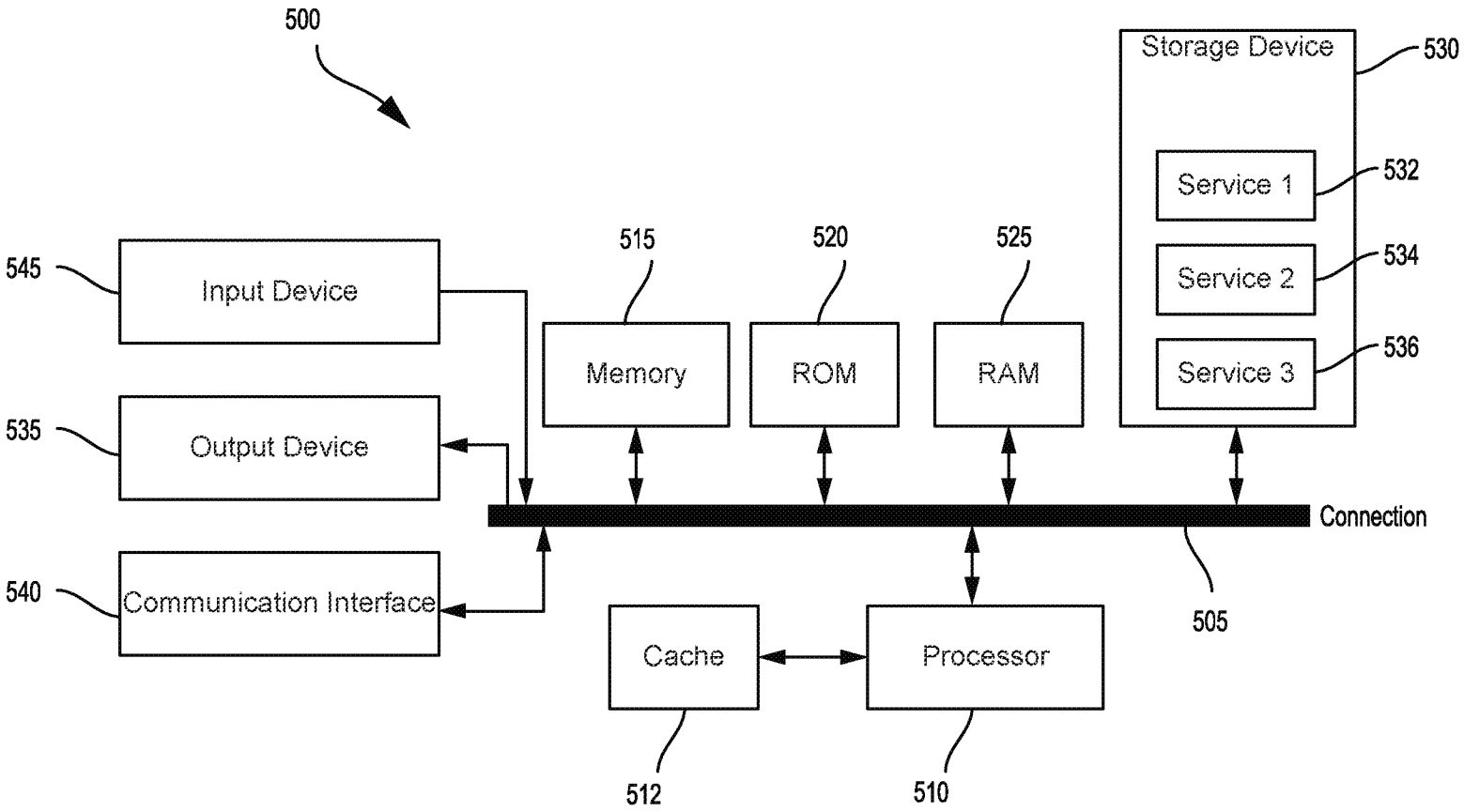
FIG. 5 is a block diagram illustrating an example computing device architecture, in accordance with aspects of the present disclosure.

FIG. 5 illustrates an example computing device architecture 500 which can be employed to perform various steps, methods, and techniques disclosed herein. Specifically, the techniques described herein can be implemented, at least in part, through the computing device architecture 500 in an applicable shoe joint, such as the shoe 202, in an applicable wellbore environment, such as the wellbore environment 200, during a reverse cementing operation. The various implementations will be apparent to those of ordinary skill in the art when practicing the present technology. Persons of ordinary skill in the art will also readily appreciate that other system implementations or examples are possible.

As noted above, FIG. 5 illustrates an example computing device architecture 500 of a computing device which can implement the various technologies and techniques described herein. The components of the computing device architecture 500 are shown in electrical communication with each other using a connection 505, such as a bus. The example computing device architecture 500 includes a processing unit (CPU or processor) 510 and a computing device connection 505 that couples various computing device components including the computing device memory 515, such as read only memory (ROM) 520 and random access memory (RAM) 525, to the processor 510.

The computing device architecture 500 can include a cache of high-speed memory connected directly with, in close proximity to, or integrated as part of the processor 510. The computing device architecture 500 can copy data from the memory 515 and/or the storage device 530 to the cache 512 for quick access by the processor 510. In this way, the cache can provide a performance boost that avoids processor 510 delays while waiting for data. These and other modules can control or be configured to control the processor 510 to perform various actions. Other computing device memory 515 may be available for use as well. The memory 515 can include multiple different types of memory with different performance characteristics. The processor 510 can include any general purpose processor and a hardware or software service, such as service 1 532, service 2 534, and service 3 536 stored in storage device 530, configured to control the processor 510 as well as a special-purpose processor where software instructions are incorporated into the processor design. The processor 510 may be a self-contained system, containing multiple cores or processors, a bus, memory controller, cache, etc. A multi-core processor may be symmetric or asymmetric.

To enable user interaction with the computing device architecture 500, an input device 545 can represent any number of input mechanisms, such as a microphone for speech, a touch-sensitive screen for gesture or graphical input, keyboard, mouse, motion input, speech and so forth. An output device 535 can also be one or more of a number of output mechanisms known to those of skill in the art, such as a display, projector, television, speaker device, etc. In some instances, multimodal computing devices can enable a user to provide multiple types of input to communicate with the computing device architecture 500. The communications interface 540 can generally govern and manage the user input and computing device output. There is no restriction on operating on any particular hardware arrangement and therefore the basic features here may easily be substituted for improved hardware or firmware arrangements as they are developed.

Storage device 530 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 525, read only memory (ROM) 520, and hybrids thereof. The storage device 530 can include services 532, 534, 536 for controlling the processor 510. Other hardware or software modules are contemplated. The storage device 530 can be connected to the computing device connection 505. In one aspect, a hardware module that performs a particular function can include the software component stored in a computer-readable medium in connection with the necessary hardware components, such as the processor 510, connection 505, output device 535, and so forth, to carry out the function.

For clarity of explanation, in some instances the present technology may be presented as including individual functional blocks including functional blocks comprising devices, device components, steps or routines in a method embodied in software, or combinations of hardware and software.

In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can include, for example, instructions and data which cause or otherwise configure a general purpose computer, special purpose computer, or a processing device to perform a certain function or group of functions. Portions of computer resources used can be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can include hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific embodiments thereof, but those skilled in the art will recognize that the application is not limited thereto. Thus, while illustrative embodiments of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Moreover, claim language reciting "at least one of" a set indicates that one member of the set or multiple members of the set satisfy the claim. For example, claim language reciting "at least one of A and B" means A, B, or A and B.

Statements of the disclosure include:

Statement 1. A method comprising: delivering a cement composition to an annulus formed between a casing and a wellbore for reverse cementing the casing; determining, based on a threshold change in a pressure measurement obtained while delivering the cement composition, that the cement composition has reached a shoe joint at a bottom portion of the casing; delivering a further amount of the cement composition to the annulus in response to determining that the cement composition has reached the shoe joint at the bottom portion of the casing; and closing the shoe joint after delivering the further amount of the cement composition.

Statement 2: The method of statement 1, wherein the pressure measurement includes at least one of an output pressure measurement corresponding to at an outlet of the casing and a discharge pressure measurement corresponding to an output of a cement pump used to deliver the cement composition.

Statement 3: The method of any of statements 1 to 2, wherein closing the shoe joint comprises: generating at least one pressure pulse using a valve at an outlet of the casing.

Statement 4: The method of any of statements 1 to 3, wherein closing the shoe joint comprises: closing a valve at an outlet of the casing.

Statement 5: The method of any of statements 1 to 4, wherein the further amount of the cement composition is based on at least one of a time duration, a number of barrels, a volume measurement, and a desired displacement.

Statement 6: The method of any of statements 1 to 5, further comprising: determining, based on one or more parameters, an expected time for the cement composition to reach the shoe joint at the bottom portion of the casing; and reducing a flow of the cement composition within a threshold time prior to the expected time.

Statement 7: The method of statement 6, wherein the one or more parameters include well depth, wellbore geometry, wellbore temperature, hydrostatic pressure, cement composition density, and cement composition flow rate.

Statement 8: The method of any of statements 1 to 7, further comprising: delivering a spacer fluid into the annulus prior to delivering the cement composition.

Statement 9: The method of any of statements 1 to 8, further comprising: receiving an indication of the threshold change in the pressure measurement from the shoe joint.

Statement 10: An apparatus comprising at least one memory; and at least one processor coupled to the at least one memory, wherein the at least one processor is configured to perform operations in accordance with any one of statements 1 to 9.

Statement 11: An apparatus comprising means for performing operations in accordance with any one of statements 1 to 9.

Statement 12: A non-transitory computer-readable medium comprising instructions that, when executed by an apparatus, cause the apparatus to perform operations in accordance with any one of statements 1 to 9.

Statement 13: A method comprising: receiving one or more pressure measurements associated with a closed wellbore during a reverse cementing operation; determining, based on a threshold change in at least one of the one or more pressure measurements, that a composition delivered through an annulus of the closed wellbore has reached a bottom portion of a casing within the closed wellbore; and initiating a trigger for closing a shoe joint after determining that the composition has reached the bottom portion of the casing.

Statement 14: The method of statement 13, wherein the trigger for closing the shoe joint is initiated after determining that a required amount of the composition has been delivered to the annulus of the closed wellbore.

Statement 15: The method of any of statements 13 to 14, wherein initiating the trigger for closing the shoe joint comprises: generating at least one pressure pulse using a valve at an outlet of the casing.

Statement 16: The method of any of statements 13 to 15, wherein initiating the trigger for closing the shoe joint comprises: closing a valve at an outlet of the casing.

Statement 17: The method of any of statements 13 to 16, further comprising: determining, based on one or more parameters, an expected time for the composition to reach the bottom portion of the casing; and reducing a flow of the composition within a threshold time prior to the expected time.

Statement 18: The method of statements 17, wherein the one or more parameters include well depth, wellbore geometry, wellbore temperature, hydrostatic pressure, cement composition density, and cement composition flow rate.

Statement 19: The method of any of statements 13 to 18, wherein the composition includes at least one of a spacer fluid and a cement composition.

Statement 20: The method of any of statements 13 to 19, further comprising: receiving an indication of the threshold change in the at least one of the one or more pressure measurements from the shoe joint.

Statement 21: The method of any of statements 13 to 20, wherein the one or more pressure measurements include at least one of an output pressure measurement corresponding to at an outlet of the casing and a discharge pressure measurement corresponding to an output of a cement pump used to deliver the composition.

Statement 22: An apparatus comprising at least one memory; and at least one processor coupled to the at least one memory, wherein the at least one processor is configured to perform operations in accordance with any one of statements 13 to 21.

Statement 23: An apparatus comprising means for performing operations in accordance with any one of statements 13 to 21.

Statement 24: A non-transitory computer-readable medium comprising instructions that, when executed by an apparatus, cause the apparatus to perform operations in accordance with any one of statements 13 to 21.

Statement 25: A system comprising: a casing extending into a wellbore, wherein an annulus is formed between the casing and the wellbore; a shoe joint positioned proximate to a bottom portion of the casing, wherein the shoe joint includes at least one valve, wherein a closed position of the at least one valve prevents flow of a cement composition from the annulus into the casing; and a shoe joint pressure sensor configured to detect a trigger for actuating the at least one valve to the closed position.

Statement 26: The system of statement 25, further comprising: an outlet pressure sensor configured to measure pressure at an outlet of the casing.

Statement 27: The system of any of statements 25 to 26, further comprising: an inlet pressure sensor configured to measure pressure at an output of a cement pump.

Statement 28: The system of any of statements 25 to 27, further comprising: an outlet valve coupled to an outlet of the casing, wherein operation of the outlet valve generates the trigger for actuating the at least one valve to the closed position.

What is claimed is:

1. A method comprising:

delivering a cement composition to an annulus formed between a casing and a wellbore for reverse cementing the casing;

determining, based on a threshold change in a pressure measurement obtained while delivering the cement composition, that the cement composition has reached a shoe joint at a bottom portion of the casing, wherein the threshold change in the pressure measurement includes an increase in a discharge pressure measurement corresponding to an output of a cement pump used to deliver the cement composition through the annulus;

delivering a further amount of the cement composition to the annulus in response to determining that the cement composition has reached the shoe joint at the bottom portion of the casing; and closing the shoe joint after delivering the further amount of the cement composition.

2. The method of claim 1, wherein the pressure measurement includes an output pressure measurement corresponding to at an outlet of the casing.

3. The method of claim 1, further comprising:

generating at least one pressure pulse based on operation of a valve at an outlet of the casing.

4. The method of claim 1, wherein closing the shoe joint comprises:

closing a valve at an outlet of the casing.

5. The method of claim 1, wherein the further amount of the cement composition is based on at least one of a time duration, a number of barrels, a volume measurement, and a desired displacement.

6. The method of claim 1, further comprising:

determining, based on one or more parameters, an expected time for the cement composition to reach the shoe joint at the bottom portion of the casing; and reducing a flow of the cement composition within a threshold time prior to the expected time.

7. The method of claim 6, wherein the one or more parameters include well depth, wellbore geometry, wellbore temperature, hydrostatic pressure, cement composition density, and cement composition flow rate.

8. The method of claim 1, further comprising:

delivering a spacer fluid into the annulus prior to delivering the cement composition.

9. The method of claim 1, further comprising:

monitoring a discharge pressure that corresponds to the output of the cement pump.

10. An apparatus comprising:

at least one memory comprising instructions; and at least one processor configured to execute the instructions and cause the apparatus to:

receive one or more pressure measurements associated with a closed wellbore during a reverse cementing operation, the one or more pressure measurements comprising a discharge pressure measurement corresponding to an output of a cement pump used to deliver a composition through an annulus of the closed wellbore;

determine, based on a threshold change in at least one of the one or more pressure measurements, that the composition delivered through the annulus of the closed wellbore has reached a bottom portion of a casing within the closed wellbore, wherein the threshold change of the at least one of the one or more pressure measurements includes an increase in the discharge pressure measurement of the output of the cement pump; and initiate a trigger for closing a shoe joint after determining that the composition has reached the bottom portion of the casing.

11. The apparatus of claim 10, wherein the trigger for closing the shoe joint is initiated after determining that a required amount of the composition has been delivered to the annulus of the closed wellbore.

12. The apparatus of claim 10, wherein to initiate the trigger for closing the shoe joint the at least one processor is further configured to cause the apparatus to:

generate at least one pressure pulse based on operation of a valve at an outlet of the casing.

13. The apparatus of claim 10, wherein to initiate the trigger for closing the shoe joint the at least one processor is further configured to cause the apparatus to:

close a valve at an outlet of the casing.

14. The apparatus of claim 10, wherein the at least on processor is further configured to cause the apparatus to:

determine, based on one or more parameters, an expected time for the composition to reach the bottom portion of the casing; and reduce a flow of the composition within a threshold time prior to the expected time.

15. The apparatus of claim 14, wherein the one or more parameters include well depth, wellbore geometry, wellbore temperature, hydrostatic pressure, a composition density, and composition flow rate.

16. The apparatus of claim 10, wherein the composition includes at least one of a spacer fluid and a cement composition.

17. The apparatus of claim 10, wherein the at least one processor is further configured to cause the apparatus to:

receive an indication of the threshold change in the at least one of the one or more pressure measurements from the shoe joint.

18. The apparatus of claim 10, wherein the one or more pressure measurements include an output pressure measurement corresponding to at an outlet of the casing.

19. A system comprising:

a casing extending into a wellbore, wherein an annulus is formed between the casing and the wellbore;

a shoe joint positioned proximate to a bottom portion of the casing, wherein the shoe joint includes at least one valve, wherein a closed position of the at least one valve prevents flow of a cement composition from the annulus into the casing; and a shoe joint pressure sensor configured to detect a trigger for actuating the at least one valve to the closed position, the trigger associated with a threshold change in a pressure measurement and an increase in the pressure measurement sensed by the shoe joint pressure sensor.

20. The system of claim 19, further comprising:

an outlet pressure sensor configured to measure pressure at an outlet of the casing;

an inlet pressure sensor configured to measure pressure at an output of a cement pump; and an outlet valve coupled to an outlet of the casing, wherein operation of the outlet valve generates the trigger for actuating the at least one valve to the closed position.

* * * * *